US009893429B2

(12) United States Patent
Yang et al.

(10) Patent No.: US 9,893,429 B2
(45) Date of Patent: Feb. 13, 2018

(54) WIDEBAND SLOT ANTENNA FOR WIRELESS COMMUNICATION DEVICES

(71) Applicant: Futurewei Technologies, Inc., Plano, TX (US)

(72) Inventors: Shing Lung Steven Yang, San Diego, CA (US); Hongyu Wang, Shenzhen (CN); Ping Shi, San Diego, CA (US); Daejoung Kim, San Diego, CA (US); Wee Kian Toh, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 283 days.

(21) Appl. No.: 13/792,512

(22) Filed: Mar. 11, 2013

(65) Prior Publication Data

US 2014/0253399 A1 Sep. 11, 2014

(51) Int. Cl.
*H01Q 13/10* (2006.01)
*H01Q 21/30* (2006.01)

(52) U.S. Cl.
CPC ..... *H01Q 13/106* (2013.01); *H01Q 21/30* (2013.01)

(58) Field of Classification Search
CPC ..... H01Q 13/106
USPC ..... 343/770, 702, 725, 867
See application file for complete search history.

(56) References Cited

U.S. PATENT DOCUMENTS 6,133,879 A 10/2000 Grangeat et al.
6,762,723 B2 * 7/2004 Nallo et al. ..... 343/700 MS
7,551,142 B1 * 6/2009 Zhang ..... H01Q 1/243 343/700 MS
7,642,964 B2 * 1/2010 DiNallo ..... H01Q 1/243 343/700 MS
7,808,435 B2 * 10/2010 Nagumo ..... H01Q 1/243 343/700 MS
8,085,202 B2 * 12/2011 Ayatollahi ..... H01Q 1/243 343/700 MS
2009/0153423 A1 * 6/2009 DiNallo ..... H01Q 1/243 343/767
2009/0153424 A1 * 6/2009 Ryou et al. ..... 343/767
2010/0238079 A1 9/2010 Ayatollahi et al.
(Continued)

FOREIGN PATENT DOCUMENTS

CN 1230037 A 9/1999
CN 201191647 Y 2/2009
CN 101577363 A 11/2009
(Continued)

OTHER PUBLICATIONS

Han, C., et al., "Wireless Communication Device with an Antenna Adjacent to an Edge of the Device," U.S. Appl. No. 13/278,836, filed Oct. 21, 2011, 34 pages.
(Continued)

*Primary Examiner* — Dameon E Levi
*Assistant Examiner* — Walter Davis
(74) *Attorney, Agent, or Firm* — Conley Rose, P.C.

(57) ABSTRACT

An antenna comprising a conductive base comprising a west edge, an east edge, a north edge, a south edge, and a center axis, a left slot of nonconductive material extending from the south edge toward the north edge and positioned between the west edge and the center axis, and a right slot of nonconductive material extending from the south edge toward the north edge and positioned between the east edge and the center axis.

20 Claims, 8 Drawing Sheets

(56) References Cited

U.S. PATENT DOCUMENTS

2011/0012790 A1* 1/2011 Badaruzzaman ..... H01Q 1/243
343/700 MS

FOREIGN PATENT DOCUMENTS

CN 102832452 A 12/2012
CN 102884680 A 1/2013

OTHER PUBLICATIONS

Szini, I., et al., "The Enhanced Bandwidth Folded Inverted Conformal Antenna (EB FICA) for Multi-Band Cellular Handsets," IEEE, 2007, pp. 4697-4700.

Di Nallo, C., et al., "Principles and Applications of the Folded Inverted Conformal Antenna (FICA) Technology," Converge 2005, Milan, Italy, Nov. 2005, 15 pages.

Partial English Translation and Abstract of Chinese Patent Application No. CN102832452A, Jul. 23, 2014, 36 pages.

Filipovic, D., et al., "A Coupled-Segment Quadrifilar Helical Antenna," MTT-S Symposium on Technologies for Wireless Applications Digest, Feb. 23-26, 1997, pp. 43-46.

Ravipati, C.B., et al., "The Goubau Multi Element Monopole Antenna—Revisited," International Symposium on Antennas and Propagation Society, Jun. 9-15, 2007, pp. 233-236.

Qing, X., et al., "Segmented Spiral Antenna for UHF Near-Field RFID," International Symposium on Antennas and Propagation (APSURSI), Jul. 3-8, 2011, pp. 996-999.

Foreign Communication From A Counterpart Application, PCT Application No. PCT/CN2014/073199, International Search Report dated May 30, 2014, 7 pages.

Foreign Communication From A Counterpart Application, PCT Application No. PCT/CN2014/073199, Written Opinion dated May 29, 2014, 6 pages.

* cited by examiner

WIDEBAND SLOT ANTENNA FOR WIRELESS COMMUNICATION DEVICES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Mobile nodes (MNs) may wirelessly transmit signals to corresponding components via an antenna. MN's may also comprise a cover, which may protect the antenna and/or other MN components during typical use. Such covers may be designed to look attractive to users and/or function as a trademark to distinguish a manufacturer's products. MN covers may comprise metallic elements. Positioning such metallic elements in close proximity to an antenna may result in reduced antenna transmission efficiency and or poor antenna reception.

SUMMARY

In one embodiment, the disclosure includes an antenna comprising a conductive base comprising a west edge, an east edge, a north edge, a south edge, and a center axis; a left slot of nonconductive material extending from the south edge toward the north edge and positioned between the west edge and the center axis, and a right slot of nonconductive material extending from the south edge toward the north edge and positioned between the east edge and the center axis.

In another embodiment, the disclosure includes a MN comprising an antenna configured to receive a current flow from a signal source wherein the current flow comprises a frequency, operate in a common mode if the current flow frequency is part of a first frequency range, operate in a left slot mode if the current flow frequency is part of a second frequency range, and operate in a right slot mode if the current flow frequency is part of a third frequency range.

In another embodiment, the disclosure includes a method comprising receiving a current flow from a signal source, operating in a common mode if the current flow comprises a frequency in a first range, operating in a left slot mode if the current flow comprises a frequency in a second range, and operating in a right slot mode if the current flow comprises a frequency in a third range.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a wideband slot antenna configured to transmit wireless signals despite being positioned in close proximity to metallic elements. The antenna may comprise a conductive base. The conductive base may comprise a left slot, a right slot, and a T slot of each comprising nonconductive material (e.g. air). The antenna may employ the conductive material of the conductive base in conjunction with the slots to operate in a common mode, a left slot mode, and a right slot mode. For example, when a current, such as a radio frequency (RF) signal with a frequency of less than about 1 Gigahertz (GHz) is applied to the antenna, the portion of the conductive base around the T slot may become active (e.g. common mode), which may result in a low frequency band transmission. As another example, when a RF signal with a frequency of about 1 GHz to about 2.04 GHz is applied to the antenna, the portion of the conductive base around the left slot may become active (e.g. left slot mode), which may result in a high frequency band transmission. As another example, when a RF signal with a frequency over about 2.05 GHz is applied to the antenna, the portion of the conductive base around the right slot may become active (e.g. right slot mode), which may result in another high frequency band transmission. The antenna may exhibit beneficial transmission characteristics in common mode, right slot mode, and/or left slot mode despite being position inside a metallic unibody cover, a cover comprising a metallic ring, a non-metallic cover, a cover comprising a non-metallic ring, and/or other covers.

Figure 1:
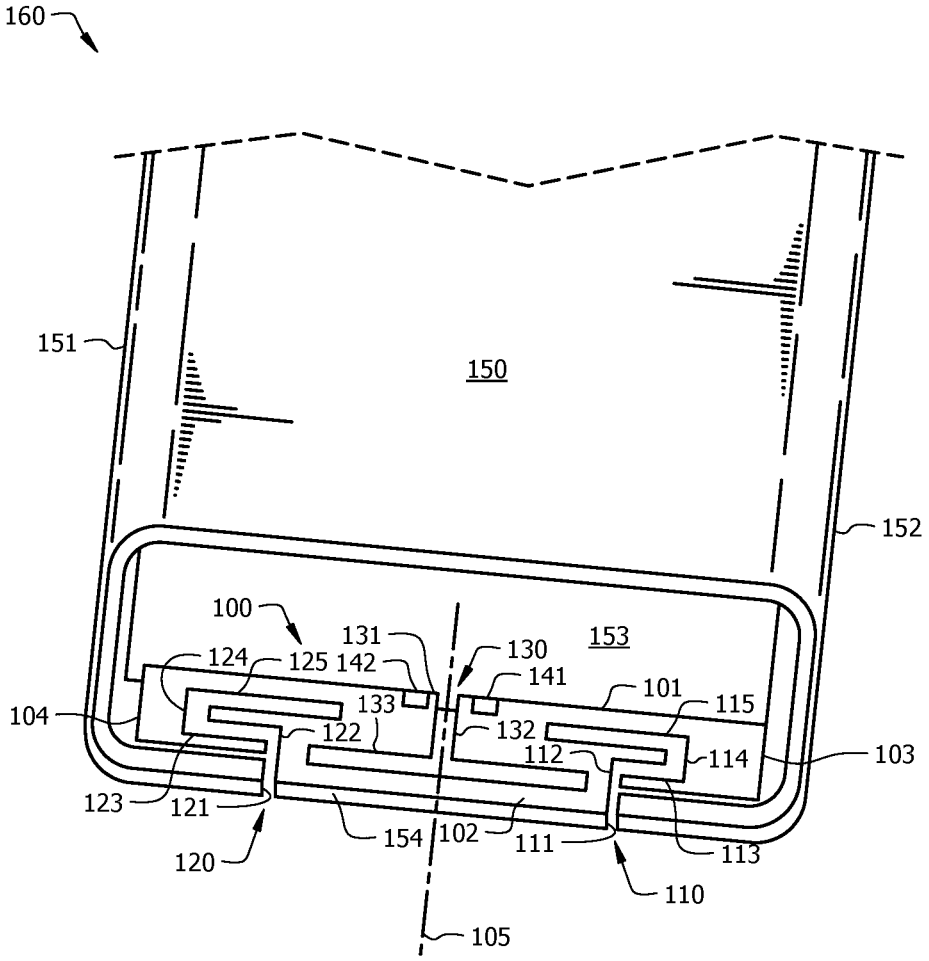
FIG. 1 is a schematic diagram of an embodiment of an MN comprising a wideband slot antenna.

FIG. 1 is a schematic diagram of an embodiment of an MN 160 comprising a wideband slot antenna 100. The antenna 100 may comprise conductive material (e.g. a metallic base), and further comprise a north edge 101, a south edge 102, an east edge 103, a west edge 104, and a center axis 105. The antenna may further comprise a left slot 120, a right slot 110, and a T slot 130, each of which may comprise a nonconductive material (e.g. air). A person of ordinary skill in the art will understand that the presence of conductive material (e.g. the metallic base) and/or the absence of conductive material (e.g. slots 110, 120, and/or 130, respectively) may affect the electrical/transmission characteristics of antenna 100. The right slot 110 may be positioned between the east edge 103 and the center axis 105. The right slot 110 may form an opening 111 in the south edge 102, a first channel 112 extending from the south edge opening 111 toward the north edge 101, a second channel 113 extending from the first channel 112 toward the east edge 103, a third channel 114 extending from the second channel 113 toward the north edge 101, and a fourth channel 115 extending from the third channel 114 toward the center axis 105, respectively. The left slot 120 may be positioned between the east edge 103 and the center axis 105. The left slot 120 may form an opening 121 in the south edge 102, a first channel 122 extending from the south edge opening 121 toward the north edge 101, a second channel 123 extending from the first channel 122 toward the west edge 104, a third channel 124 extending from the second channel 123 toward the north edge 101, and a fourth channel 125 extending from the third channel 124 toward the center axis 105, respectively. The T slot 130 may be positioned between left slot 120 and right slot 110. The T slot 130 may form an opening 131 in the north edge 101 at or near the center axis 105. The T slot 130 may further comprise a first channel 132 extending from the north edge opening 131 toward the south edge 102, and a second channel 133 extending toward the west edge 104, toward the east edge 103, and through the first channel 132. The first channel 132 may be substantially parallel to the center axis 105 and the second channel 133 may be positioned substantially perpendicular to the center axis 105.

The antenna 100 may further comprise and/or be coupled to a signal feed 141 and a ground trace 142. The signal feed 141 may be coupled to the north edge 101 between the north edge opening 131 and the fourth channel 115 of the right slot 110. The ground trace 142 may be coupled to the north edge 101 between the north edge opening 131 and the fourth channel 125 of the left slot 120. The signal feed 141 may be configured to receive electrical signals, such as RF signals, from a signal source, which may be positioned on board 153 (e.g. a printed circuit board (PCB)), and transmit the electrical signals toward the ground trace 142 via the conductive material of the antenna 100. The electrical signal(s) may comprise an alternating current and may achieve resonance while traversing the antenna 100, which may result in a portion of the electrical signals leaving the antenna 100 as a wireless transmission. The electrical signals may be described in terms of a wavelength, frequency, amplitude, etc. The frequency of the signals at a specified time may affect the behavior antenna 100 and associated electrical characteristics, as discussed below. For example, depending on the frequency of the electrical signal, the antenna may operate in common mode, left slot mode, and/or right slot mode as discussed with respect to FIGS. 2A-2C, 3A-3B, and 4A-4B, respectively.

The antenna 100 may be positioned in a MN cover 150. The cover 150 may comprise metallic elements, non-metallic elements, and/or combinations thereof. The cover 150 may be of any size large enough to contain the MN's 160 components. For example, the MN cover 150 may be about 130 millimeters (mm)×about 65 mm×about 8.9 mm. The MN cover 150 may comprise an east edge 152, a west edge 151, and a south edge 154. The south edge 102 of the antenna 100 may be connected to the south edge 154 of the cover 150 in an area bounded by the left slot 120 and the right slot 110. The south edge 102 of the antenna 100 may not be connected to the south edge of the cover 150 in an area extending between the left slot 120 and the west edge 104 of the antenna 100 and/or in an area extending between the right slot 120 and the east edge 103 of the antenna 100. The cover 150 may further comprise slot openings that correspond to the left slot opening 121 and the right slot opening 111. The distance between the west edge 151 of the cover 150 and the left slot opening 121 may be about 16.5 mm. The distance between the east edge 152 of the cover 150 and the right slot opening 111 may be also about 16.5 mm. The antenna 100 may also be positioned at least about 6 mm away from any other MN 160 components that comprise metallic materials, as metallic elements may have adverse effect on signal quality.

It should be noted that the terms north, south, east, west, left, and right are arbitrary terms as used herein and are employed solely to identify the antenna's 100 and/or MN's 160 components in a clear and logical manner. Such terms are not intended to imply any direction or orientation requirements for any components discussed herein.

Figure 2A:
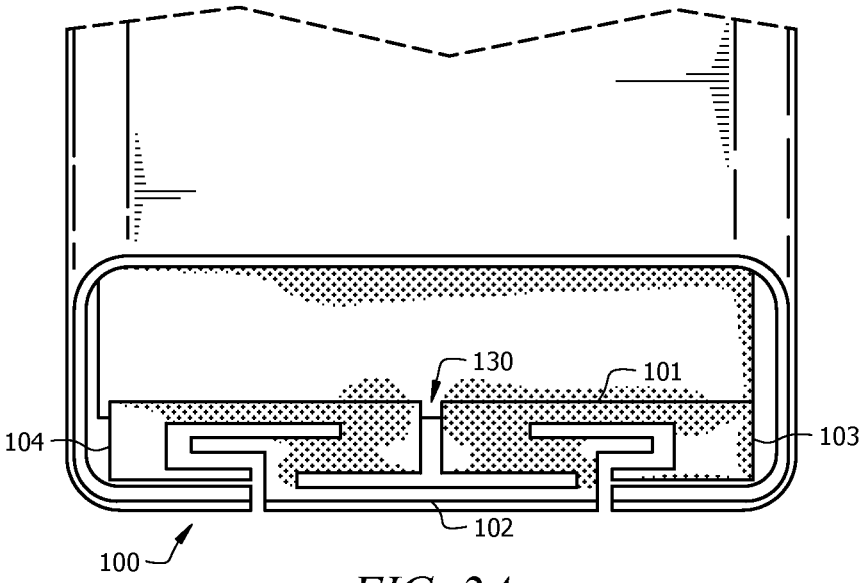
FIG. 2A is an illustration of current flows in an embodiment of a wideband slot antenna operating in common mode.

FIG. 2A is an illustration of current flows in an embodiment of a wideband slot antenna 100 operating in common mode. In FIG. 2A charge density associated with current flow(s) may be depicted as a plurality of dots. The antenna 100 may enter into common mode when receiving electrical signals with a frequency of less than about 1 GHz from a signal source. As shown in FIG. 2A when antenna 100 is in common mode, electrical current may flow between T slot 130 and the east edge 103 and between the T slot 130 and the west edge 104. This may result in wireless transmission(s) emanating from both sides of antenna 100 (e.g. east/right side and west/left side, respectively).

Figure 2B:
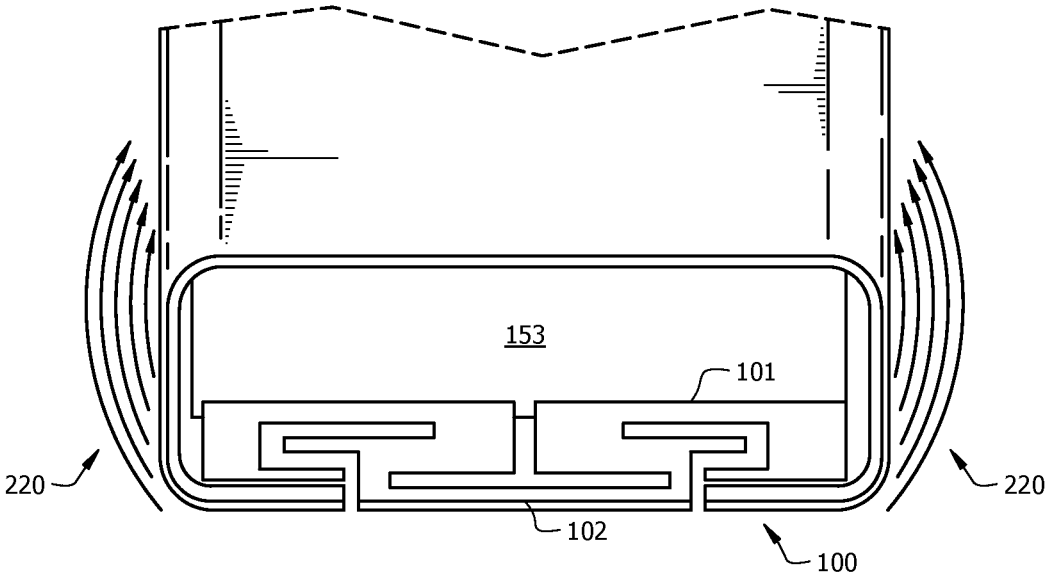
FIG. 2B is a schematic diagram of an electromagnetic field of an embodiment of a wideband slot antenna operating in common mode.

FIG. 2B is a schematic diagram of an electromagnetic field (E-field) 220 of an embodiment of a wideband slot antenna 100 operating in common mode (e.g. when receiving electrical signals with a frequency of less than about 1 GHz from a signal source.) When receiving electrical signals from a signal source, the antenna 100 may exhibit an E-field (such as E-field 220). E-field 220 may be represented by a plurality of arrows, which may illustrate the relative direction and magnitude of the E-Field 220 at various locations. The E-field may change based on the frequency of the electric signal and/or operating mode. E-field 220 may result when antenna 100 is operating in common mode. As shown in FIG. 2B, antenna 100 may be positioned adjacent to a PCB 153, which may act as a ground plane. When operating in common mode, E-Field 220 may extend away from the south edge and beyond the north edge in the direction of the PCB 153.

Figure 3A:
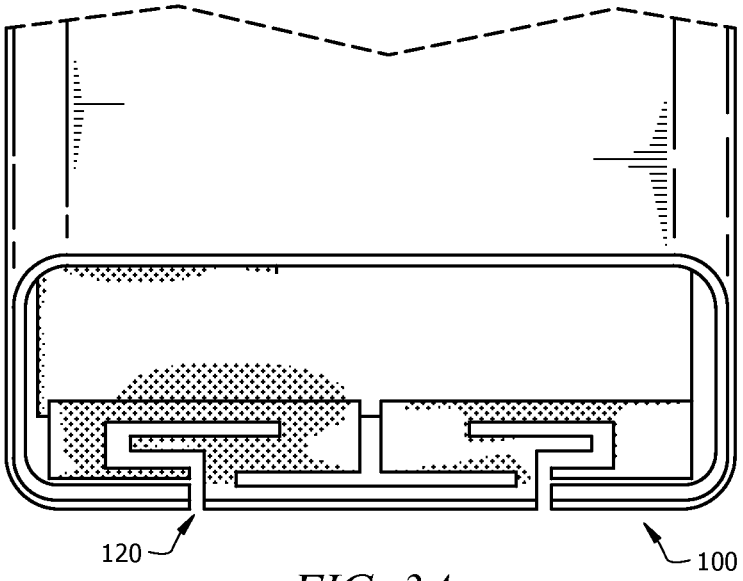
FIG. 3A is an illustration of current flows in an embodiment of a wideband slot antenna operating in left slot mode.

FIG. 3A is an illustration of current flows in an embodiment of a wideband slot antenna 100 operating in left slot mode. In FIG. 3A charge density associated with current flow(s) may be depicted as a plurality of dots. The antenna 100 may enter into left slot mode when receiving electrical signals from a signal source with a frequency of about 1 GHz to about 2.04 GHz. As shown in FIG. 3A when antenna 100 is in left slot mode, electrical current may flow primarily around the left slot 120. This may result in wireless transmission(s) emanating from the west/left side of antenna 100. Wireless signals may comprise a wavelength. The length of the left slot 120 (e.g. the cumulative length of the first channel 122, second channel 123, third channel 124, and fourth channel 125), may be equal to about one quarter of the wavelength of the wireless signals emitted by the antenna 100 when in left slot mode.

Figure 3B:
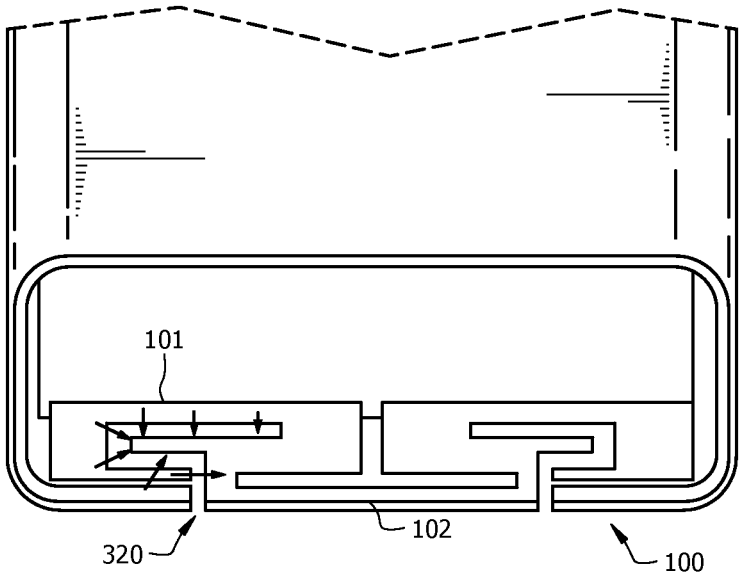
FIG. 3B is a schematic diagram of an electromagnetic field of an embodiment of a wideband slot antenna operating in left slot mode.

FIG. 3B is a schematic diagram of an E-field 320 of an embodiment of a wideband slot antenna 100 operating in left slot mode (e.g. when receiving electrical signals from a signal source with a frequency of about 1 GHz to about 2.04 GHz.) When operating in left slot mode, E-Field 320 may extend across the left slot 120. As shown by the length of the arrows illustrating E-field 320, the E-field may be stronger closer to the south edge 102 and weaker toward the north edge 101.

Figure 4A:
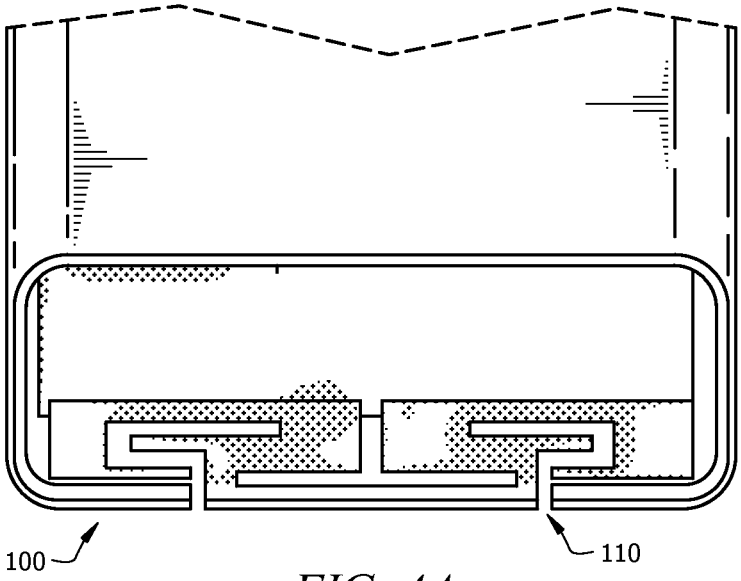
FIG. 4A is an illustration of current flows in an embodiment of a wideband slot antenna operating in right slot mode.

FIG. 4A is an illustration of current flows in an embodiment of a wideband slot antenna 100 operating in right slot mode. In FIG. 4A charge density associated with current flow(s) may be depicted as a plurality of dots. The antenna 100 may enter into right slot mode when receiving electrical signals from a signal source with a frequency of greater than about 2.05 GHz. As shown in FIG. 4A when antenna 100 is in right slot mode, electrical current may flow primarily around the right slot 110. This may result in wireless transmission(s) emanating from the east/right side of antenna 100. The length of the right slot 110 (e.g. the cumulative length of the first channel 112, second channel 113, third channel 114, and fourth channel 115), may be equal to about one quarter of the wavelength of the wireless signals emitted by the antenna 100 when in right slot mode.

Figure 4B:
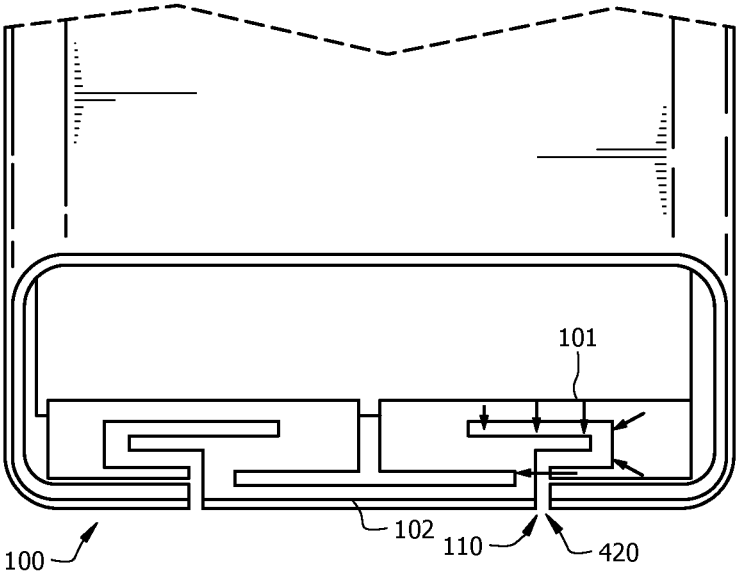
FIG. 4B is a schematic diagram of an electromagnetic field of an embodiment of a wideband slot antenna operating in right slot mode.

FIG. 4B is a schematic diagram of an E-field of an embodiment of a wideband slot antenna 100 operating in right slot mode (e.g. when receiving electrical signals from a signal source with a frequency of greater than about 2.05 GHz.) When operating in right slot mode, E-Field 420 may extend across the right slot 110. As shown by the length of the arrows illustrating E-field 420, the E-field may be stronger closer to the south edge 102 and weaker toward the north edge 101.

Figure 5:
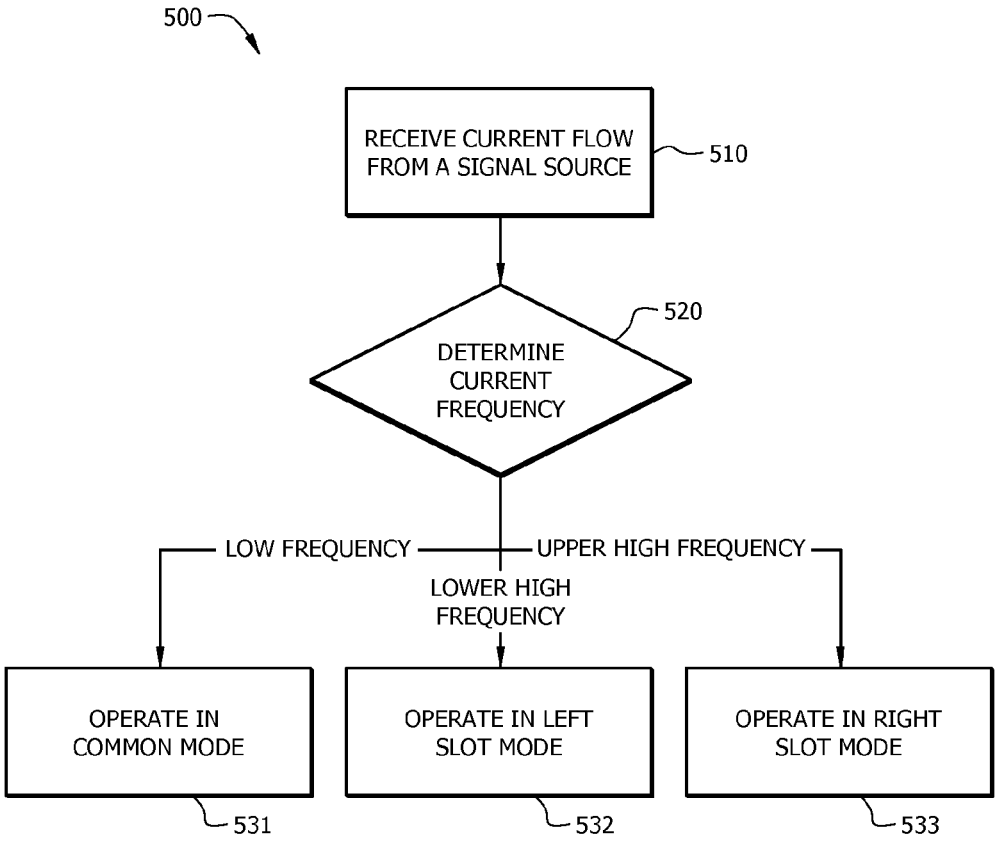
FIG. 5 is a flowchart of an embodiment of a method of transmitting a wireless signal.

FIG. 5 is a flowchart of an embodiment of a method 500 of transmitting a wireless signal. Method 500 may be implemented by an antenna, such as antenna 100. At step 510, a current flow is received from a signal source. At step 520, the method may determine the frequency of the current flow. If the current comprises a low frequency (e.g. less than about 1 GHz), the method may proceed to step 531 and operate in common mode by communicating the current around a T slot. If the current comprises a lower high frequency (e.g. between about 1 GHz and about 2.04 GHz), the method may proceed to step 532 and operate in left slot mode by communicating the current around a left slot. If the current comprises an upper high frequency (e.g. greater than about 2.05 GHz), the method may proceed to step 533 and operate in right slot mode by communicating the current around a right slot.

Figure 6:
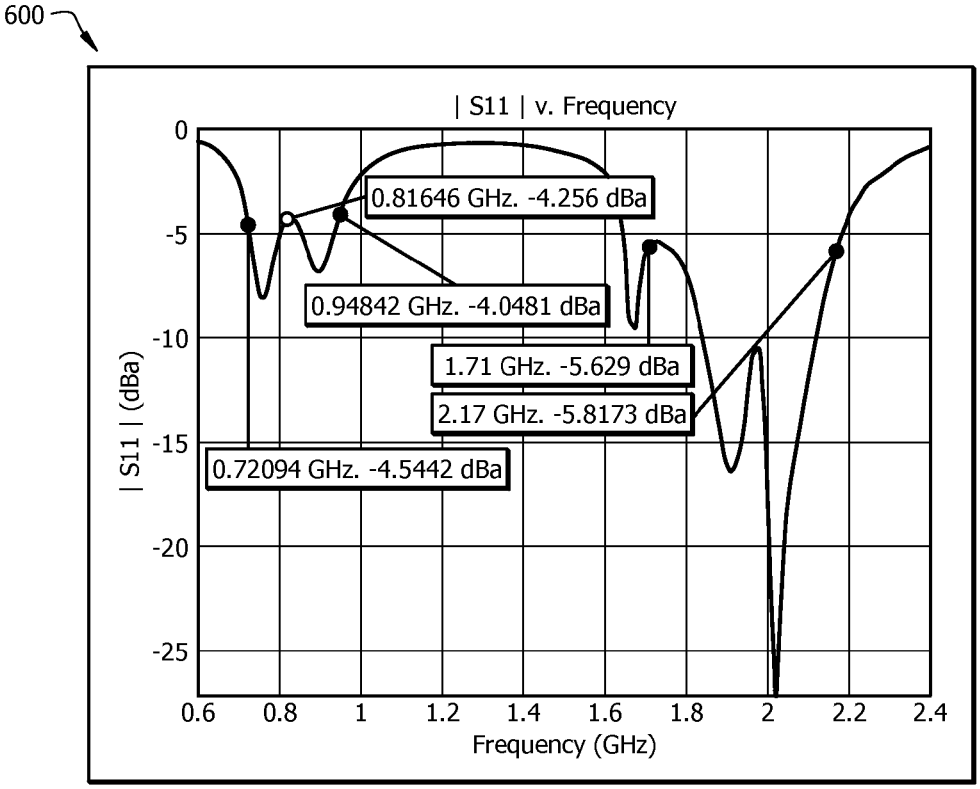
FIG. 6 is a graph of radiation efficiency of an embodiment of a wideband slot antenna.

FIG. 6 is a graph 600 of radiation efficiency of an embodiment of a wideband slot antenna 100. Graph 600 may compare radiation frequency measured in decibels (dB s) to wireless signal frequency measure in GHz. Radiation efficiency may the total power radiated by an antenna divided by the net power accepted by the antenna from a connected transmitter at a specified frequency. A radiation efficiency of between about −4 dB and about −6 dB may be beneficial for transmission of a specified wireless signal. As shown in FIG. 6, antenna 100 may maintain a radiation efficiency of between about −4 dB and about −6 dB over a broad range of wireless signal frequencies (e.g. about 0.7 GHz to about 0.75 GHz, about 0.77 GHz to about 0.96 GHz, about 1.62 GHz to about 1.65 GHz, about 1.7 GHz to about 1.8 GHz, about 2.15 GHz to about 2.25 GHz.)

Figure 7:
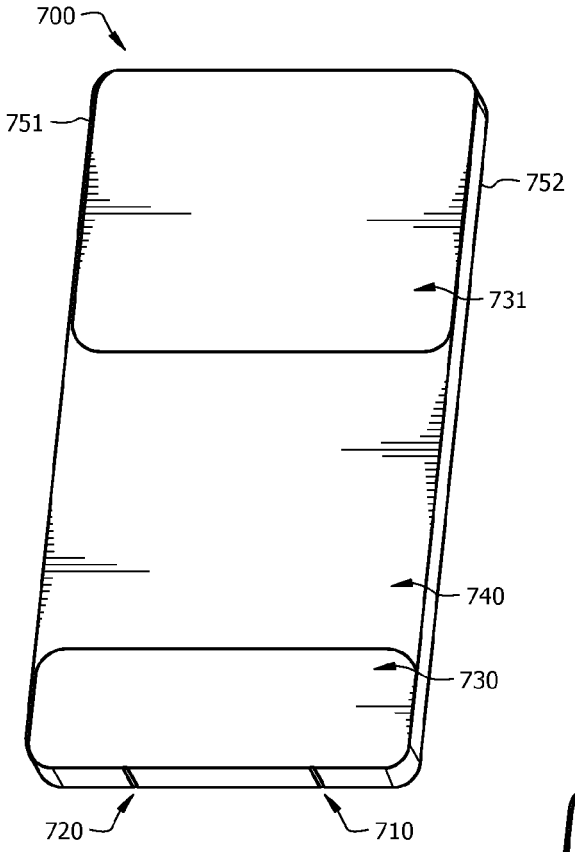
FIG. 7 is a perspective view of an embodiment of an MN cover.

FIG. 7 is a perspective view of an embodiment of an MN cover 700. MN cover 700 may comprise a metallic unibody portion 740, an upper non-metallic portion 731 (e.g. plastic, rubber, etc.), and a lower non-metallic portion 730 (e.g. plastic, rubber, etc.) Antenna 100 may be positioned inside MN cover 700 beneath the upper non-metallic portion 731 and/or the lower non-metallic portion 730. In this configuration, the antenna 100 may be positioned inside a metallic unibody cover 740 while being positioned far enough from metallic elements to maintain the beneficial transmission characteristics as discussed above. MN cover 700 may comprise slots 710 and 720, which may be positioned to connect to the first channel 111 of right slot 110 and the first channel 121 of left slot 120, respectively. Slots 710 and 720 may be positioned about 16.5 mm from east edge 752 and west edge 751, respectively.

Figure 8:
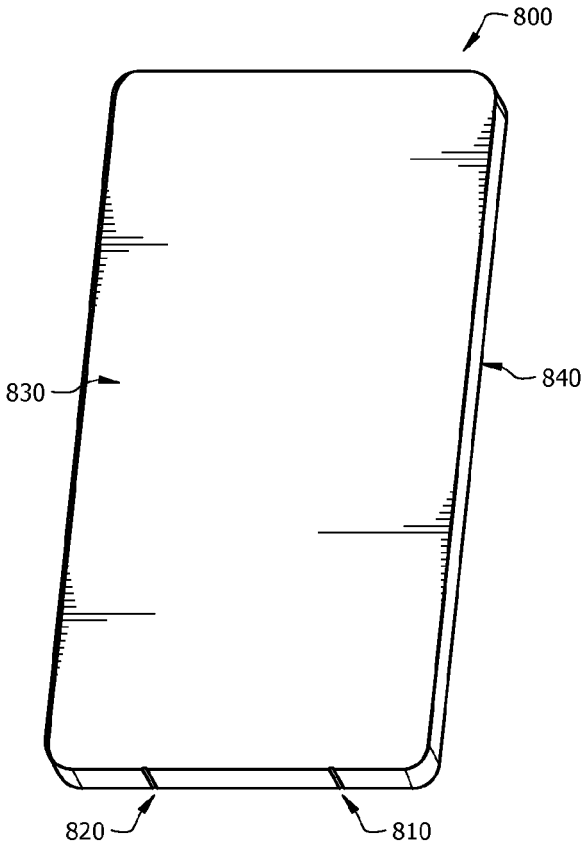
FIG. 8 is a perspective view of an embodiment of another MN cover.

FIG. 8 is a perspective view of an embodiment of another MN cover 800. MN cover 800 may comprise a metallic ring 840 and a nonmetallic portion 830 (e.g. plastic, rubber, etc.) Antenna 100 may be positioned inside MN cover 800, which may allow the antenna 100 to be positioned inside a metallic ring 840 while being positioned far enough from metallic elements to maintain the beneficial transmission characteristics as discussed above. MN cover 800 may also comprise slots 810 and 820, which may be substantially similar to slots 810 and 820, respectively. It should be noted that antenna 100 may also maintain the beneficial transmission characteristics as discussed above when positioned inside a non-metallic ring and/or non-metallic unibody structure.

Figure 9:
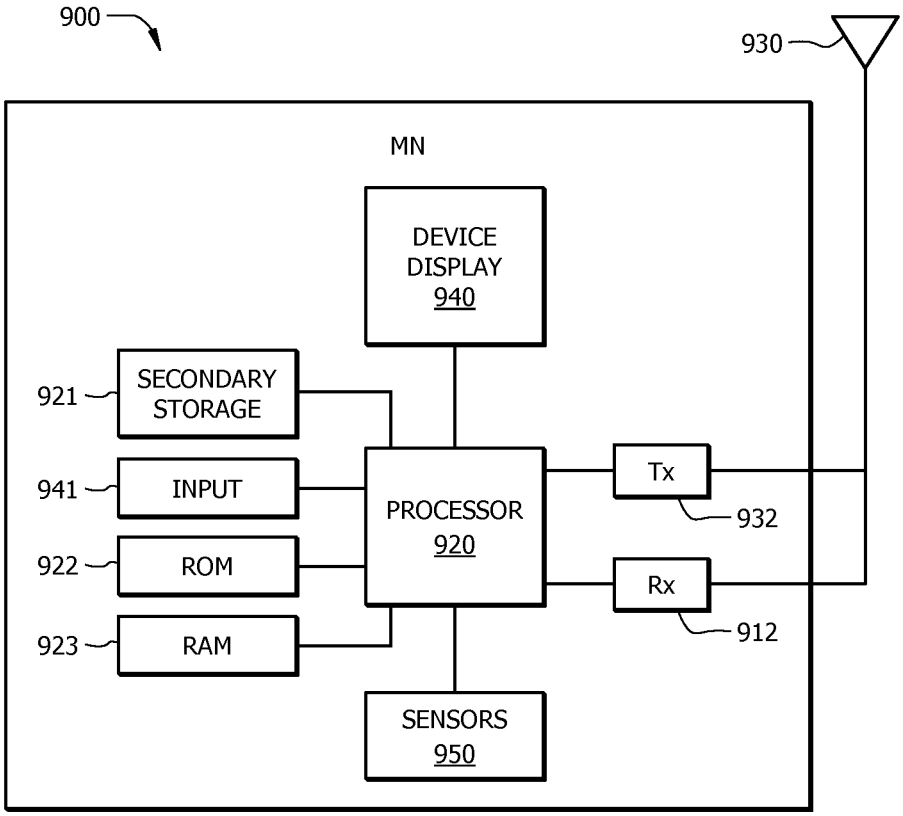
FIG. 9 is a schematic diagram of an embodiment of a MN.

FIG. 9 is a schematic diagram of an embodiment of a MN 900, which may comprise antenna 100, MN cover 700 and/or MN cover 800. MN 900 may comprise a two-way wireless communication device having voice and/or data communication capabilities. In some aspects, voice communication capabilities are optional. The MN 900 generally has the capability to communicate with other computer systems on the Internet and/or other networks. Depending on the exact functionality provided, the MN 900 may be referred to as a data messaging device, a tablet computer, a two-way pager, a wireless e-mail device, a cellular telephone with data messaging capabilities, a wireless Internet appliance, a wireless device, a smart phone, a mobile device, or a data communication device, as examples.

MN 900 may comprise a processor 920 (which may be referred to as a central processor unit or CPU) that may be in communication with memory devices including secondary storage 921, read only memory (ROM) 922, and random access memory (RAM) 923. The processor 920 may be implemented as one or more general-purpose CPU chips, one or more cores (e.g., a multi-core processor), or may be part of one or more application specific integrated circuits (ASICs) and/or digital signal processors (DSPs). The processor 920 may be implemented using hardware, software, firmware, or combinations thereof.

The secondary storage 921 may be comprised of one or more solid state drives and/or disk drives which may be used for non-volatile storage of data and as an over-flow data storage device if RAM 923 is not large enough to hold all working data. Secondary storage 921 may be used to store programs that are loaded into RAM 923 when such programs are selected for execution. The ROM 922 may be used to store instructions and perhaps data that are read during program execution. ROM 922 may be a non-volatile memory device may have a small memory capacity relative to the larger memory capacity of secondary storage 921. The RAM 923 may be used to store volatile data and perhaps to store instructions. Access to both ROM 922 and RAM 923 may be faster than to secondary storage 921.

MN 900 may be any device that communicates data (e.g., packets) wirelessly with a network. The MN 900 may comprise a receiver (Rx) 912, which may be configured for receiving data, packets, or frames from other components. The receiver 912 may be coupled to the processor 920, which may be configured to process the data and determine to which components the data is to be sent. The MN 900 may also comprise a transmitter (Tx) 932 coupled to the processor 920 and configured for transmitting data, packets, or frames to other components. The receiver 912 and transmitter 932 may be coupled to an antenna 930, which may be configured to receive and transmit wireless (radio) signals. As an example, antenna 930 may comprise and/or be substantially similar to antenna 100. As another example, Tx 932 may comprise and/or be substantially similar to an electrical/RF signal source as discussed above.

The MN 900 may also comprise a device display 940 coupled to the processor 920, for displaying output thereof to a user. The device display 920 may comprise a light-emitting diode (LED) display, a Color Super Twisted Nematic (CSTN) display, a thin film transistor (TFT) display, a thin film diode (TFD) display, an organic LED (OLED) display, an active-matrix OLED display, or any other display screen. The device display 940 may display in color or monochrome and may be equipped with a touch sensor based on resistive and/or capacitive technologies.

The MN 900 may further comprise input devices 941 coupled to the processor 920, which may allow a user to input commands to the MN 900. In the case that the display device 940 comprises a touch sensor, the display device 940 may also be considered an input device 941. In addition to and/or in the alternative, an input device 941 may comprise a mouse, trackball, built-in keyboard, external keyboard, and/or any other device that a user may employ to interact with the MN 900. The MN 900 may further comprise sensors 950 coupled to the processor 920. Sensors 950 may detect and/or measure conditions in and/or around MN 900 at a specified time and transmit related sensor input and/or data to processor 920.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, Ru, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 7 percent, . . . , 70 percent, 71 percent, 72 percent, . . ., 97 percent, 96 percent, 97 percent, 98 percent, 99 percent, or 100 percent. Moreover, any numerical range defined by two R numbers as defined in the above is also specifically disclosed. The use of the term "about" means ±10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. An antenna comprising:

a conductive base comprising:

a west edge, an east edge, a north edge, a south edge, and a center axis substantially parallel to the west edge and the east edge;

a left slot of nonconductive material extending from the south edge toward the north edge and positioned between the west edge and the center axis without extending across the center axis; and a right slot of nonconductive material extending from the south edge toward the north edge and positioned between the east edge and the center axis without extending across the center axis, wherein the antenna has a single feed coupled to the north edge, wherein the north edge is closer to components that are adjacent to the antenna than the south edge, and wherein a terminal end of each of the left slot and the right slot is closer to the center axis than remaining portions of the left slot and the right slot.

2. The antenna of claim 1, wherein the left slot comprises:
a first channel extending from the south edge toward the north edge;
a second channel extending from the first channel toward the west edge;
a third channel extending from the second channel toward the north edge; and
a fourth channel extending from the third channel toward the center axis.

3. The antenna of claim 1, wherein the right slot comprises:
a first channel extending from the south edge toward the north edge;
a second channel extending from the first channel toward the east edge;
a third channel extending from the second channel toward the north edge; and
a fourth channel extending from the third channel toward the center axis.

4. The antenna of claim 1, wherein the conductive base further comprises a T slot of nonconductive material extending from the north edge toward the south edge and positioned between the left slot and the right slot.

5. The antenna of claim 4, wherein the T slot comprises:
a first channel extending from the north edge toward the south edge; and
a second channel extending toward the west edge, toward the east edge, and through the first channel.

6. The antenna of claim 5, wherein the first channel is positioned substantially parallel to the center axis, and wherein the second channel is positioned substantially perpendicular to the first channel.

7. The antenna of claim 4, wherein the conductive base is configured to:
receive an electrical signal from a signal feed; and
emit an electromagnetic field (E-field) based on a frequency of the electric signal,
wherein the E-field extends across the left slot for a first frequency range.

8. The antenna of claim 7, wherein the E-field extends across the right slot for a second frequency range.

9. The antenna of claim 8, wherein the E-field extends away from the south edge and beyond the north edge for a third frequency range.

10. The antenna of claim 9, wherein the third frequency range comprises frequencies of less than about 1 Gigahertz (GHz), wherein the first frequency range comprises frequencies from about 1 GHz to about 2.04 GHz, and wherein the second frequency range comprises frequencies of greater than about 2.05 GHz.

11. The antenna of claim 4, wherein the conductive base is configured to transmit a wireless signal, wherein the wireless signal comprises a wavelength, and wherein the left slot, the right slot, or both comprise a length of about one quarter of the wireless signal wavelength.

12. A mobile node (MN) comprising:
an antenna having a single feed and configured to:
receive a current flow from a signal source, wherein the current flow comprises a frequency;
operate in a common mode when the current flow frequency is part of a first frequency range;
operate in a left slot mode using a left slot when the current flow frequency is part of a second frequency range; and
operate in a right slot mode using a right slot when the current flow frequency is part of a third frequency range,
wherein the left slot and the right slot are disposed in the antenna without extending across a center axis substantially parallel to a west edge and an east edge of a conductive base,
wherein the single feed is coupled to a north edge of the conductive base containing the left slot and the right slot,
wherein the north edge of the conductive base is closer to components that are adjacent to the antenna than a south edge of the conductive base, and
wherein a terminal end of each of the left slot and the right slot is closer to the center axis than remaining portions of the left slot and the right slot.

13. The MN of claim 12, wherein the antenna comprises:
a T slot for common mode operation.

14. The MN of claim 12 further comprising a metallic unibody cover, wherein the antenna is positioned inside the metallic unibody cover.

15. The MN of claim 12 further comprising a non-metallic unibody cover, wherein the antenna is positioned inside the non-metallic unibody cover.

16. The MN of claim 12 further comprising a metallic ring, wherein the antenna is positioned inside the metallic ring.

17. A method comprising:
receiving a current flow from a single signal source;
operating in a common mode if the current flow comprises a frequency in a first range;
operating in a left slot mode using a left slot when the current flow comprises a frequency in a second range; and
operating in a right slot mode using a right slot when the current flow comprises a frequency in a third range,
wherein the left slot and the right slot are disposed in an antenna without extending across a center axis substantially parallel to a west edge and an east edge of a conductive base,
wherein the single signal source is coupled to a north edge of the conductive base containing the left slot and the right slot,
wherein the north edge of the conductive base is closer to components that are adjacent to the antenna than a south edge of the conductive base, and
wherein a terminal end of each of the left slot and the right slot is closer to the center axis than remaining portions of the left slot and the right slot.

18. The method of claim 17, wherein operating in common mode comprises communicating the current flow around a T slot.

19. The method of claim 17, wherein operating in right slot mode comprises communicating the current flow around the right slot.

20. The method of claim 17, wherein operating in left slot mode comprises communicating the current flow around the left slot.

* * * * *